US011209018B2

(12) United States Patent
He et al.

(10) Patent No.: US 11,209,018 B2
(45) Date of Patent: Dec. 28, 2021

(54) BLOWER

(71) Applicant: Zhongshan Broad-Ocean Motor Co., Ltd., Zhongshan (CN)

(72) Inventors: Jinhao He, Zhongshan (CN); Jincheng Zhu, Zhongshan (CN); Junyu Liang, Zhongshan (CN); Guiwen Fu, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 0 days.

(21) Appl. No.: 16/902,290

(22) Filed: Jun. 16, 2020

(65) Prior Publication Data

US 2020/0309155 A1 Oct. 1, 2020

Related U.S. Application Data

(63) Continuation-in-part of application No. PCT/CN2018/103752, filed on Sep. 3, 2018.

(30) Foreign Application Priority Data

Feb. 5, 2018 (CN) ..... 201810112200.4
Feb. 5, 2018 (CN) ..... 201820194826.X

(51) Int. Cl.

| | |
|---|---|
| ***F04D 29/28*** | (2006.01) |
| ***F04D 29/62*** | (2006.01) |
| ***F04D 25/08*** | (2006.01) |
| *F04D 29/30* | (2006.01) |

(52) U.S. Cl.

CPC ..... *F04D 29/624* (2013.01); *F04D 25/08* (2013.01); *F04D 29/281* (2013.01); *F04D 29/30* (2013.01)

(58) Field of Classification Search

CPC ..... F04D 25/08; F04D 29/263; F04D 29/282; F04D 29/283; F04D 29/669

See application file for complete search history.

(56) References Cited

U.S. PATENT DOCUMENTS 3,775,029 A * 11/1973 Ranz ..... F04D 29/626 417/353
4,108,568 A * 8/1978 Townsend ..... F04D 29/282 415/102
4,859,888 A * 8/1989 Ohbayashi ..... H02K 29/08 310/68 R (Continued)

FOREIGN PATENT DOCUMENTS

CN 201861590 U 6/2011
CN 202370872 U 8/2012

(Continued)

*Primary Examiner* — Ninh H. Nguyen
(74) *Attorney, Agent, or Firm* — Matthias Scholl P.C.; Matthias Scholl

(57) ABSTRACT

A blower, including: a motor; a tubular wind wheel, a mounting plate and a connection part. The tubular wind wheel includes a plurality of blades and a plurality of connection rings. The plurality of blades is connected to each other to form an elongated hollow body. The connection part is disposed in the elongated hollow body. The mounting plate is disposed outside one end of the tubular wind wheel. The motor is disposed on the mounting plate. At least a part of the motor extends into the elongated hollow body to connect to the connection part.

7 Claims, 11 Drawing Sheets

(56) References Cited

U.S. PATENT DOCUMENTS

| | | | | |
|---|---|---|---|---|
| 7,210,907 | B2 * | 5/2007 | Patti | F04D 29/282 416/178 |
| 9,685,840 | B2 * | 6/2017 | Germann | H02K 3/522 |
| 9,745,988 | B2 * | 8/2017 | Hodgson | F04D 29/083 |
| 2006/0093472 | A1 * | 5/2006 | Chen | F04D 29/283 415/129 |
| 2009/0067982 | A1 | 3/2009 | Ko | |

FOREIGN PATENT DOCUMENTS

| | | | |
|---|---|---|---|
| CN | 202768497 | U | 3/2013 |
| CN | 204458475 | U | 7/2015 |
| CN | 107559236 | A | 1/2018 |
| CN | 108167233 | A | 6/2018 |
| EP | 1008760 | A1 | 6/2000 |
| JP | 2002188596 | A | 7/2002 |

* cited by examiner

BLOWER

CROSS-REFERENCE TO RELATED APPLICATIONS

This application is a continuation-in-part of International Patent Application No. PCT/CN2018/103752 with an international filing date of Sep. 3, 2018, designating the United States, and further claims foreign priority benefits to Chinese Patent Application No. 201810112200.4 filed Feb. 5, 2018, and to Chinese Patent Application No. 201820194826.X filed Feb. 5, 2018. The contents of all of the aforementioned applications, including any intervening amendments thereto, are incorporated herein by reference.

BACKGROUND

The disclosure relates to a blower.

As shown in FIGS. 1 and 2, a conventional air conditioner blower comprises a tubular wind wheel a and a motor b driving the tubular wind wheel a. A faceplate d is disposed on one end face of the tubular wind wheel a. The rotation shaft c of the motor b passes through the faceplate d and extends into the cavity of the tubular wind wheel a. Two end faces of the motor are provided with a first damping ring e1 and a second damping ring e2, respectively. An installation plate f is disposed outside the first damping ring e1. A fixed mount g is disposed outside the second damping ring e2. The fixed mount g comprises a plurality of connection rods h. The fixed mount g and the connection rods h fix the motor b on the installation plate f. The blower has a plurality of parts, and thus is bulky.

SUMMARY

The disclosure provides a blower.

The blower comprises a motor; a tubular wind wheel, a mounting plate and a connection part. The tubular wind wheel comprises a plurality of blades and a plurality of connection rings; the plurality of blades is connected to each other to form an elongated hollow body; the connection part is disposed in the elongated hollow body; the mounting plate is disposed outside one end of the tubular wind wheel; the motor is disposed on the mounting plate; at least a part of the motor extends into the elongated hollow body to connect to the connection part.

The connection part comprises a connection plate spaced from the one end of the tubular wind wheel; the connection plate is connected to the plurality of blades; the connection plate comprises a central hole and a lug boss surrounding the central hole; the motor comprises a rotating shaft passing through the central hole and being encircled by the lug boss.

The plurality of blades is connected to each other through the plurality of connection rings disposed at intervals; and the connection plate is disposed between two adjacent connection rings on the one end of the tubular wind wheel.

The connection plate comprises a plurality of vent holes around the central hole.

The motor comprises an inner rotor assembly, a stator assembly; a plastic-capsulated casing and the rotating shaft; the stator assembly and the inner rotor assembly are disposed in the plastic-capsulated casing; the rotating shaft is disposed in the inner rotor assembly; the plastic-capsulated casing comprises a plurality of circumferential legs; and the mounting plate is fixedly connected to the plurality of circumferential legs.

The motor comprises an outer rotor assembly, a stator assembly; a plastic-capsulated seat, and the rotating shaft; the stator assembly is disposed in the plastic-capsulated seat; the outer rotor assembly encompasses the plastic-capsulated seat; the rotating shaft is connected to the outer rotor assembly; one end of the rotating shaft extends out of the outer rotor assembly and is connected to the connection plate; the plastic-capsulated seat comprises a plurality of circumferential legs; and the mounting plate is fixedly connected to the plurality of circumferential legs.

The plurality of blades are connected to each other through the plurality of connection rings disposed at intervals; one of the plurality of connection rings on the one end of the tubular wind wheel bends to form a sleeve parallel to the plurality of blades; the motor comprises an outer rotor assembly, a stator assembly, a plastic-capsulated seat, and the rotating shaft; the stator assembly is disposed in the plastic-capsulated seat; the rotating shaft is connected to the outer rotor assembly; the outer rotor assembly encompasses the plastic-capsulated seat; and the sleeve encircles a circumferential wall of the outer rotor assembly.

A gap is disposed between the plurality of blades and the sleeve.

The motor comprises a plurality of circumferential legs; a plurality of damping pads encircles the plurality of circumferential legs, respectively; the plurality of damping pads each comprises a first end face and a second end face connected to the first end face; the mounting plate is attached to the first end face of each damping pad; the mounting plate comprises a plurality of fasteners; the plurality of fasteners each is attached to the second end face of each damping pad to fix the motor on the mounting plate.

The mounting plate comprises two subplates in threaded connection to each other.

Compared with conventional blowers, advantages of the blower according to embodiments of the disclosure are summarized as follows:

1) The connection part is disposed in the elongated hollow body, and at least a part of the motor extends into the elongated hollow body to connect to the connection part. This shortens the overall length of the tubular wind wheel connected to the motor, which is conducive to developing miniaturized air conditioners.

2) The connection plate is connected to the plurality of blades, the connection plate comprises a central hole and a lug boss surrounding the central hole; the motor comprises a rotating shaft passing through the central hole and being encircled by the lug boss. The design strengthens the connection between the motor and the wind wheel.

3) The connection plate comprises a plurality of vent holes around the central hole. This accelerates the air movement in the elongated hollow body.

4) One of the plurality of connection rings on the one end of the tubular wind wheel 2 bends to form a sleeve parallel to the plurality of blades. The sleeve covers the circumferential wall of the outer rotor assembly of the motor. The design simplifies the installation of the motor on the wind wheel.

5) The motor comprises a plurality of circumferential legs; a plurality of damping pads encircles the plurality of circumferential legs, respectively; the plurality of damping pads each comprises a first end face and a second end face connected to the first end face; the mounting plate is attached to the first end face of each damping pad; the mounting plate comprises a plurality of fasteners; the plurality of fasteners each is attached to the second end face of each damping pad to fix the motor on the mounting plate. The design simplifies the installation of the motor on the wind wheel.

DETAILED DESCRIPTION

Figure 1:
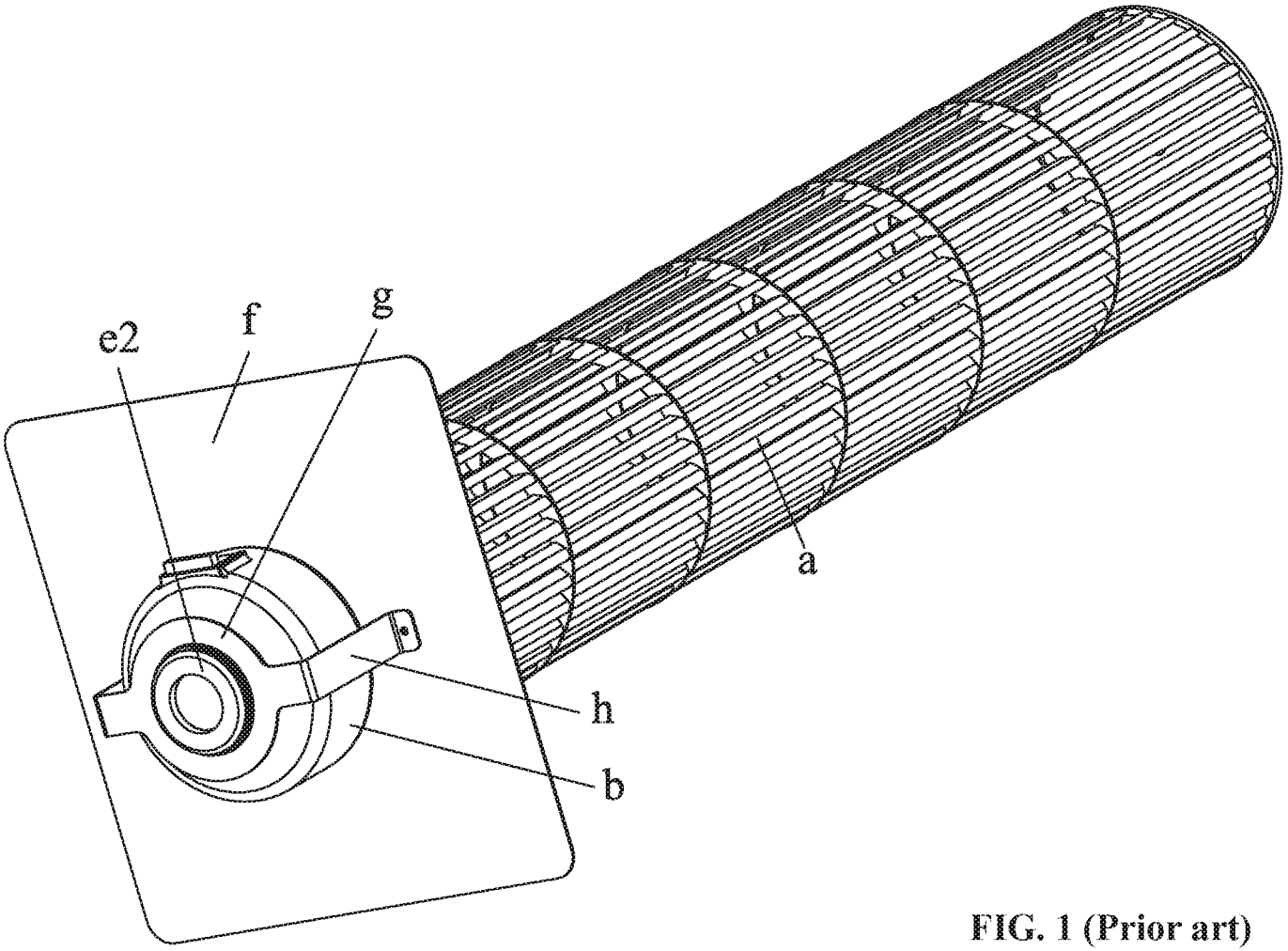
FIG. 1 (Prior art)
FIG. 1 is a schematic diagram of a blower in the prior art.
Figure 2:
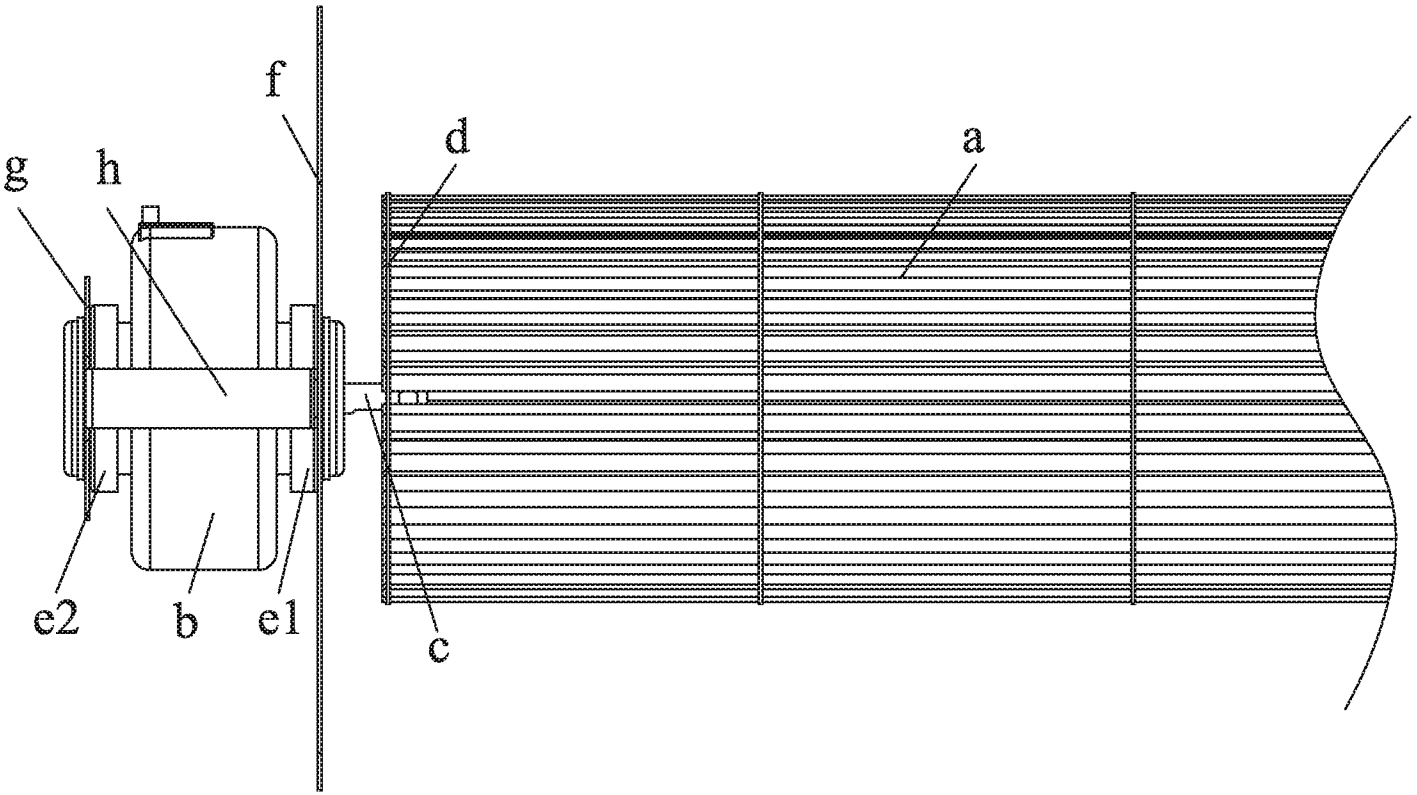
FIG. 2 (Prior art)
FIG. 2 is a side view of a blower in the prior art.
Figure 3:
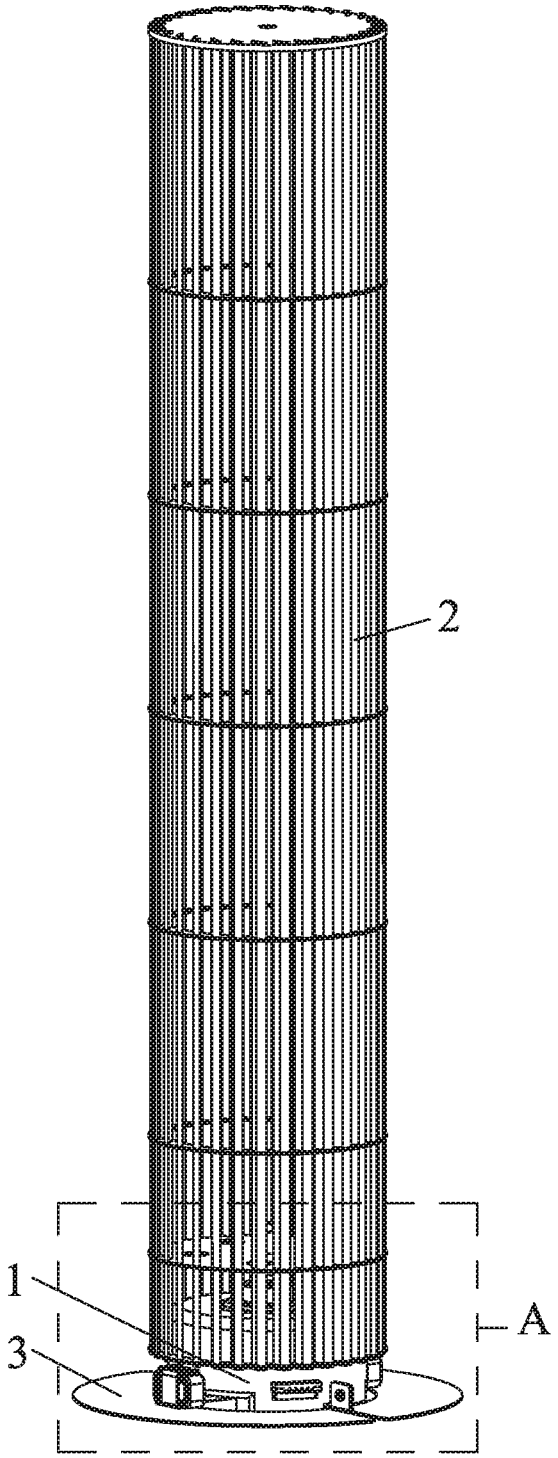
FIG. 3 is a schematic diagram of a blower according to one embodiment of the disclosure.
Figure 4:
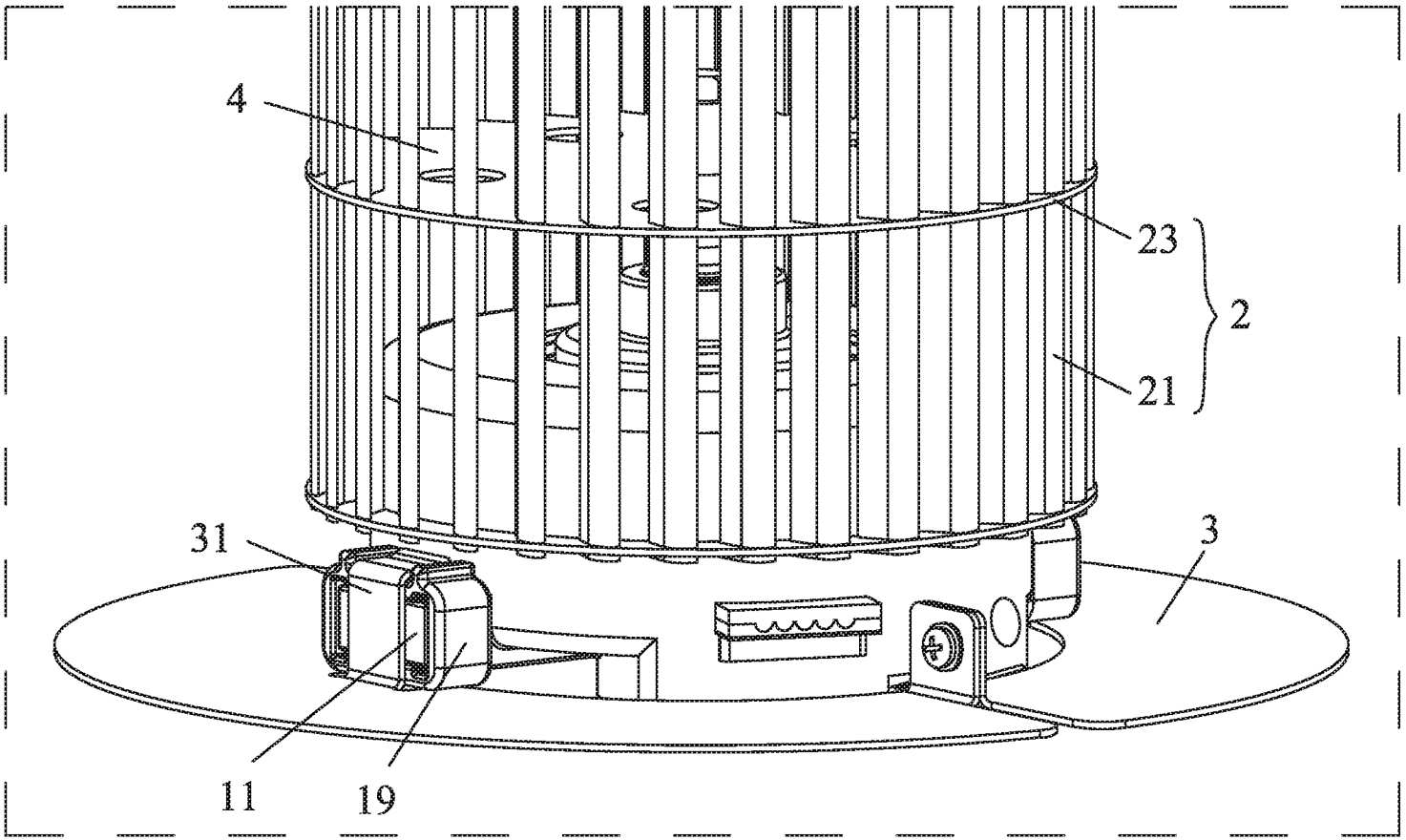
FIG. 4 is a local enlarged view of part A in FIG. 3.
Figure 5:
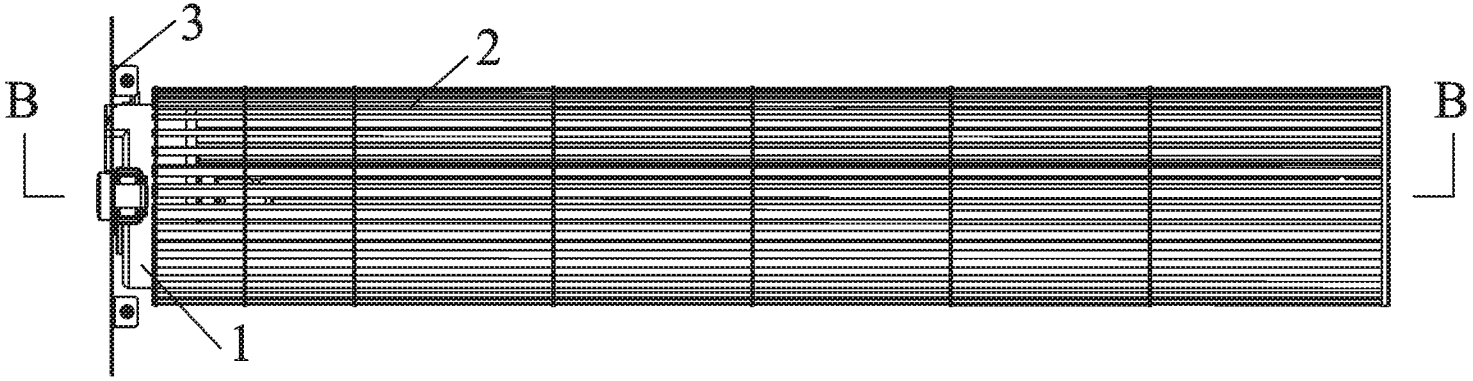
FIG. 5 is a side view of a blower according to one embodiment of the disclosure.
Figure 6:
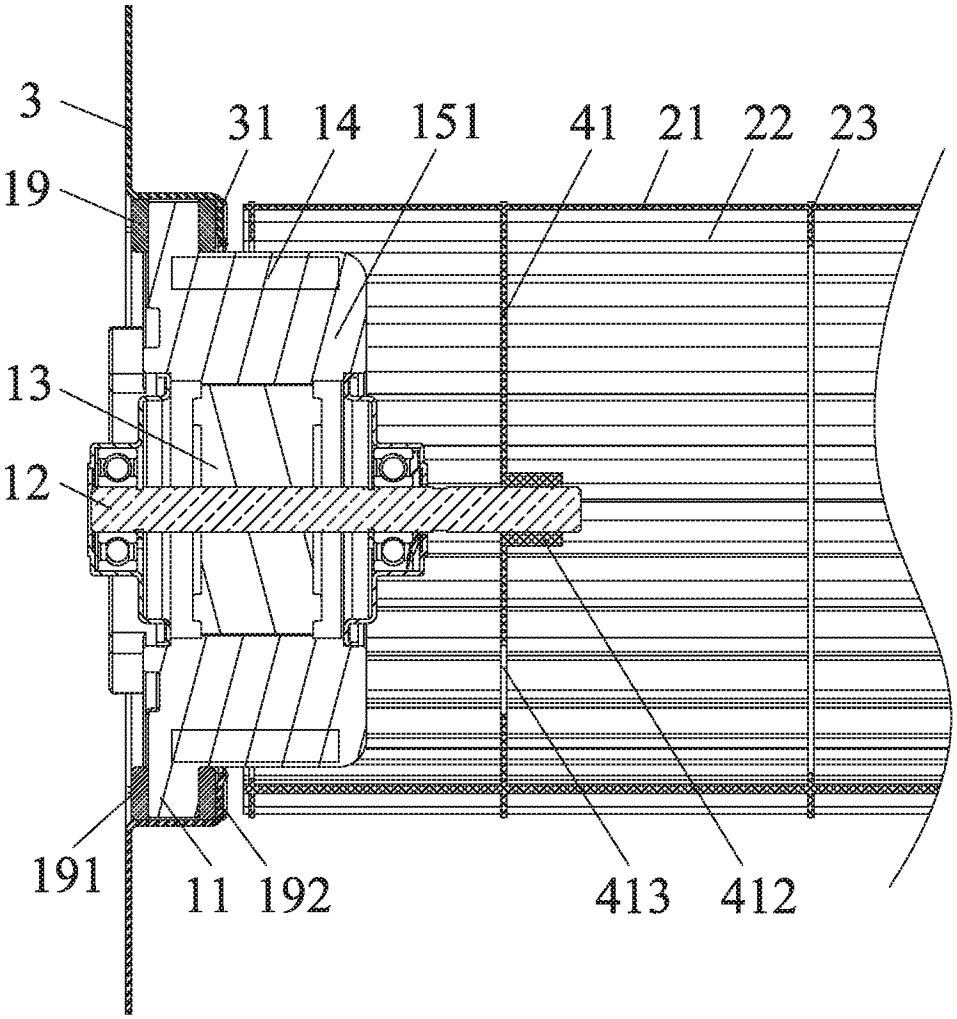
FIG. 6 is a sectional view taken from line B-B in FIG. 5.
Figure 7:
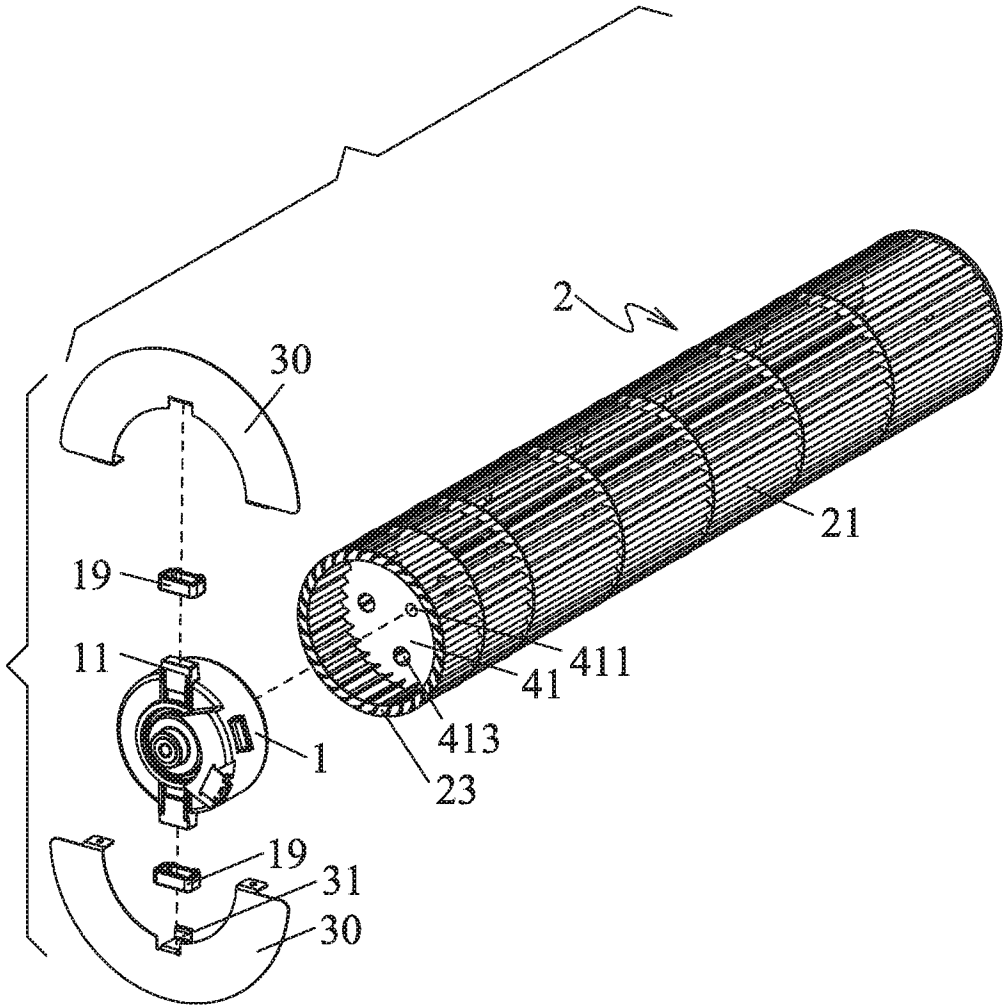
FIG. 7 is an exploded view of a blower according to one embodiment of the disclosure.

To further illustrate the disclosure, embodiments detailing a blower are described below. It should be noted that the following embodiments are intended to describe and not to limit the disclosure.

Example 1

As shown in FIGS. 3-7, a blower comprises a motor 1; a tubular wind wheel 2, a mounting plate 3 and a connection part 4. The tubular wind wheel 2 comprises a plurality of blades 21 and a plurality of connection rings 23; the plurality of blades 21 is connected to each other to form an elongated hollow body 22; the connection part 4 is disposed in the elongated hollow body 22; the mounting plate 3 is disposed outside one end of the tubular wind wheel 2; the motor is disposed on the mounting plate 3; at least a part of the motor extends into the elongated hollow body 22 to connect to the connection part 4.

The connection part 4 is disposed in the elongated hollow body 22, and at least a part of the motor extends into the elongated hollow body 22 to connect to the connection part 4. This shortens the overall length of the tubular wind wheel 2 connected to the motor, which is conducive to developing miniaturized air conditioners.

The connection part 4 comprises a connection plate 41 spaced from the one end of the tubular wind wheel 2; the connection plate 41 is connected to the plurality of blades 21; the connection plate 41 comprises a central hole 411 and a lug boss 412 surrounding the central hole 411; the motor comprises a rotating shaft 12 passing through the central hole 411 and being encircled by the lug boss 412.

The plurality of blades 21 are connected to each other through the plurality of connection rings 23 disposed at intervals; and the connection plate 41 is disposed between two adjacent connection rings 23 on the one end of the tubular wind wheel 2.

The connection plate 41 comprises a plurality of vent holes 413 around the central hole 411.

The motor 1 comprises an inner rotor assembly 13, a stator assembly 14, a plastic-capsulated casing 151 and the rotating shaft 12; the stator assembly 14 and the inner rotor assembly 13 are disposed in the plastic-capsulated casing 151; the rotating shaft 12 is disposed in the inner rotor assembly 13; the plastic-capsulated casing 151 comprises a plurality of circumferential legs 11; and the mounting plate 3 is fixedly connected to the plurality of circumferential legs 11.

A plurality of damping pads 19 encircles the plurality of circumferential legs 11, respectively; the plurality of damping pads 19 each comprises a first end face and a second end face connected to the first end face; the mounting plate 3 is attached to the first end face of each damping pad; the mounting plate 3 comprises a plurality of fasteners 31; the plurality of fasteners 31 each is attached to the second end face of each damping pad to fix the motor 1 on the mounting plate 3.

The plurality of damping pads 19 is a damping ring encompassing the circumferential legs 11.

The mounting plate 3 comprises two subplates 30 in threaded connection to each other.

Example 2

Figure 8:
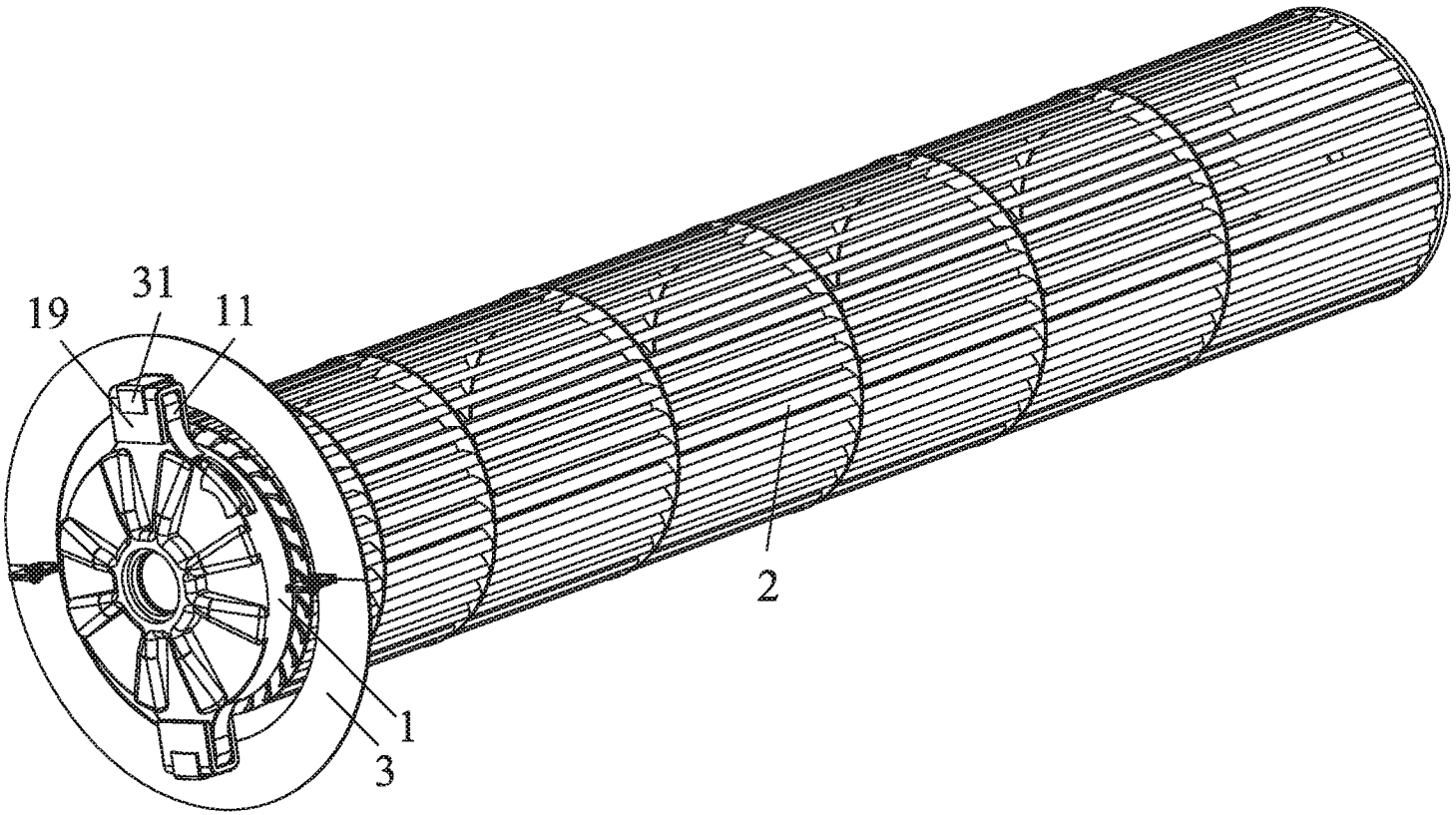
FIG. 8 is a schematic diagram of a blower according to another embodiment of the disclosure.
Figure 9:
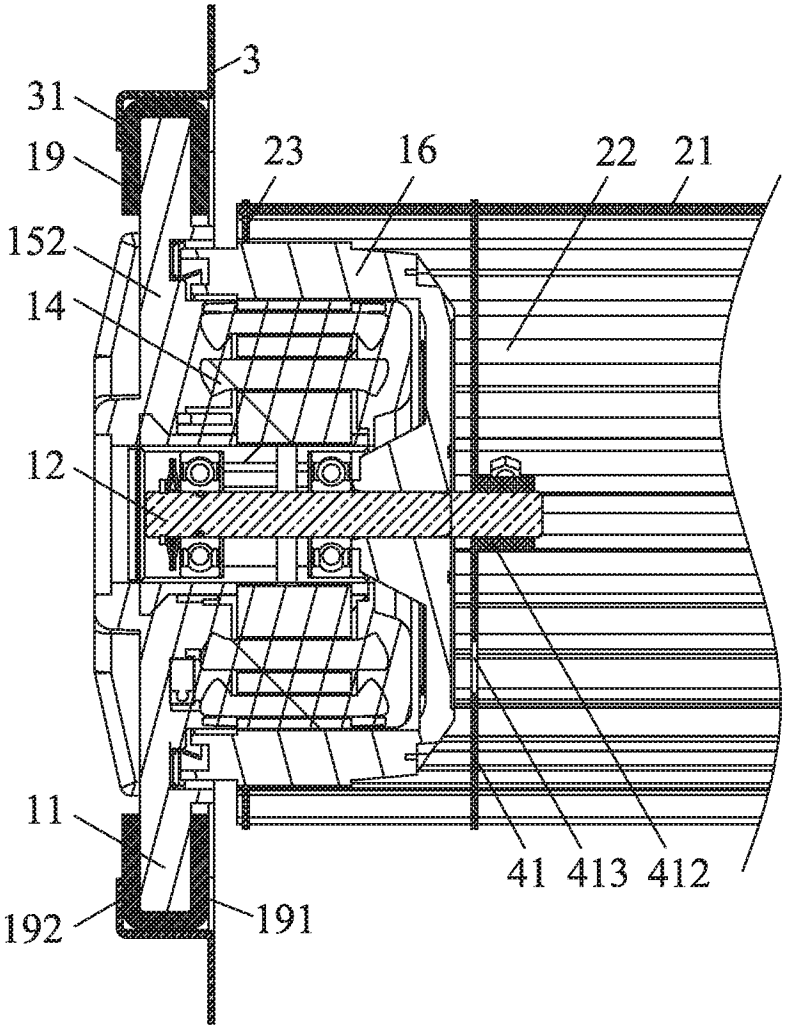
FIG. 9 is a sectional view of a blower according to another embodiment of the disclosure.

As shown in FIGS. 8-9, the blower is basically the same as that in Example 1 except that:

the motor 1 comprises an outer rotor assembly 16, a stator assembly 14, a plastic-capsulated seat 152, and the rotating shaft 12; the stator assembly 14 is disposed in the plastic-capsulated seat 152; the outer rotor assembly 16 encompasses the plastic-capsulated seat 152; the rotating shaft 12 is connected to the outer rotor assembly 16; one end of the rotating shaft 12 extends out of the outer rotor assembly 16 and is connected to the connection plate 41; the plastic-capsulated seat 152 comprises a plurality of circumferential legs 11; and the mounting plate 3 is fixedly connected to the plurality of circumferential legs 11.

Example 3

Figure 10:
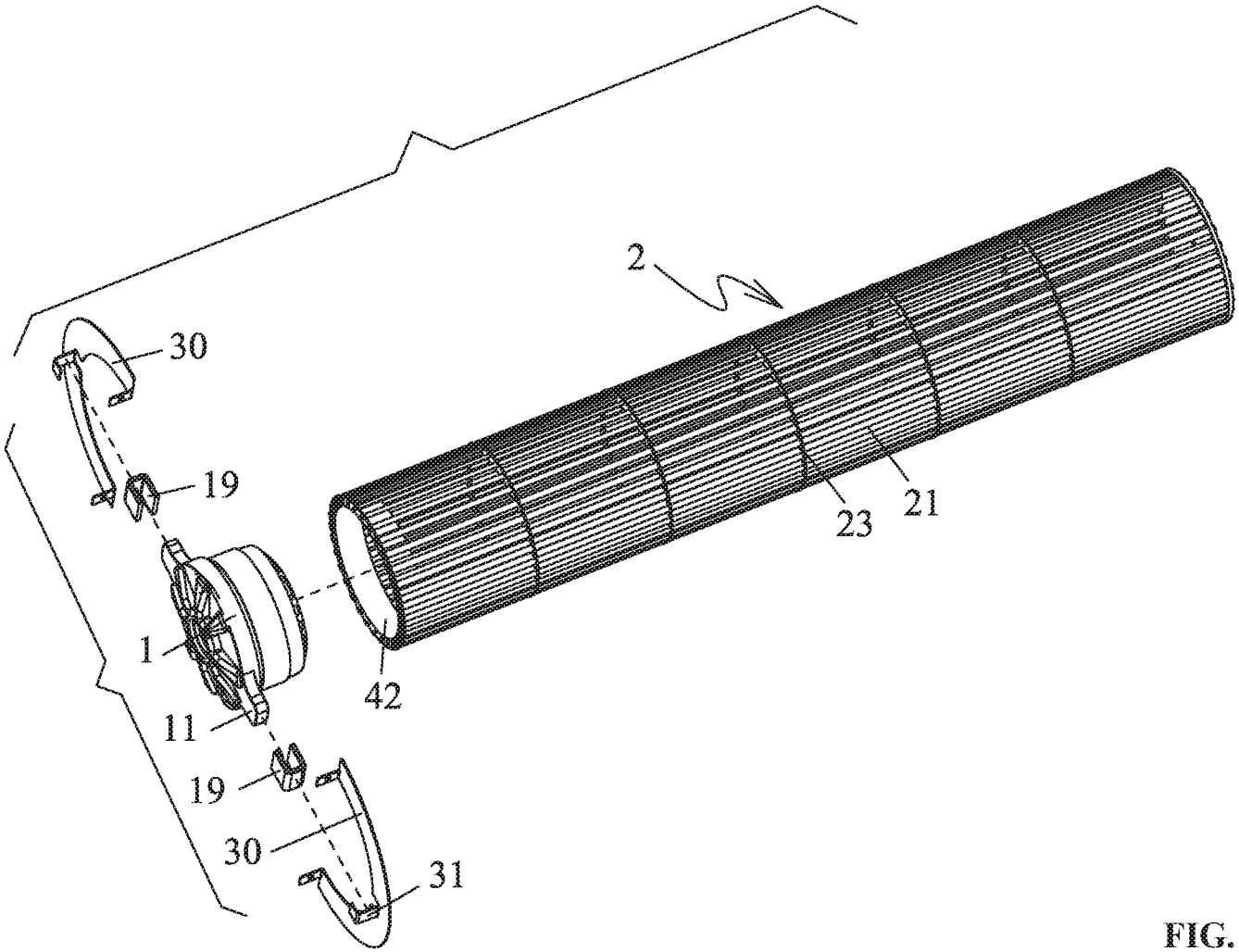
FIG. 10 is an exploded view of a blower according to still another embodiment of the disclosure.
Figure 11:
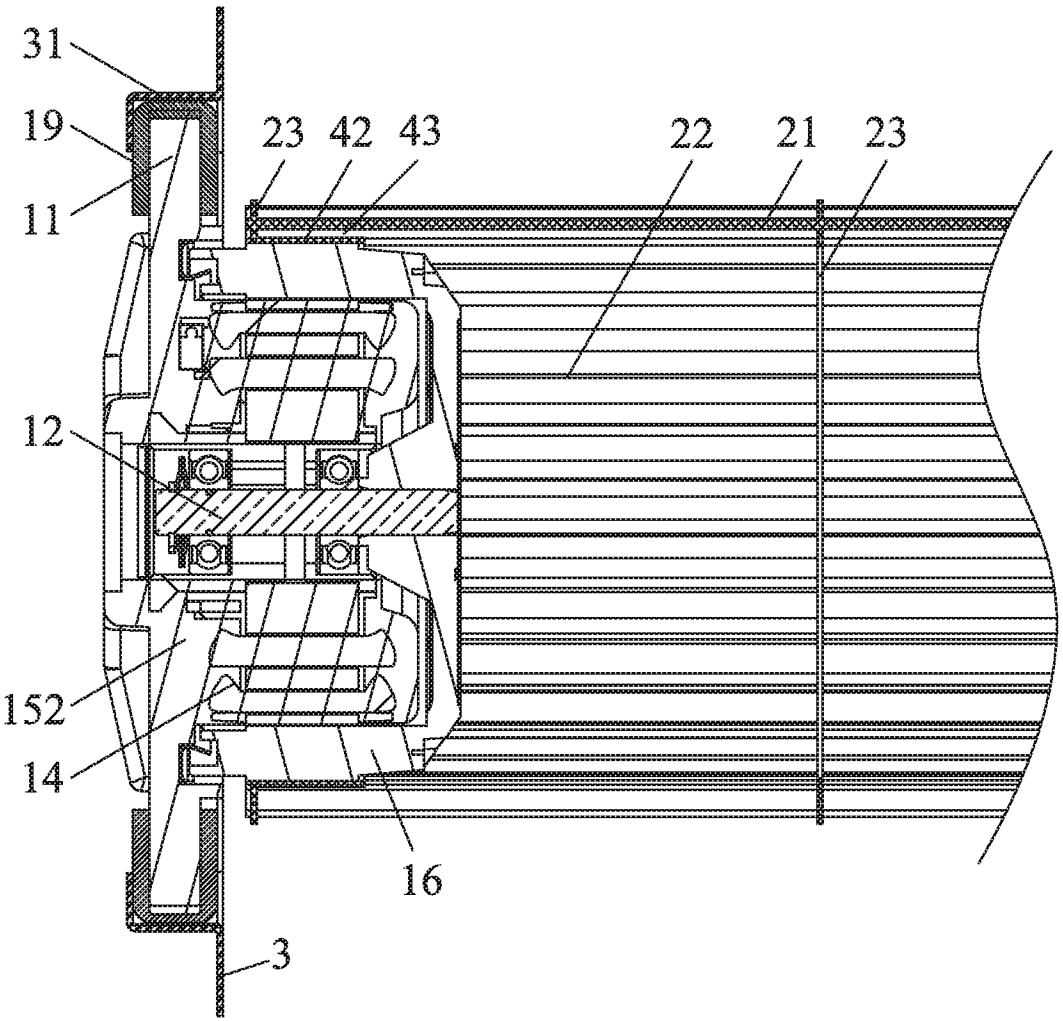
FIG. 11 is a sectional view of a blower according to still another embodiment of the disclosure.

As shown in FIGS. 10-11, the blower is basically the same as that in Example 2 except that:

the plurality of blades 21 are connected to each other through the plurality of connection rings 23 disposed at intervals; one of the plurality of connection rings 23 on the one end of the tubular wind wheel 2 bends to form a sleeve 42 parallel to the plurality of blades 21; the motor 1 comprises an outer rotor assembly 16, a stator assembly 14, a plastic-capsulated seat 152, and the rotating shaft 12; the stator assembly 14 is disposed in the plastic-capsulated seat 152; the rotating shaft 12 is connected to the outer rotor assembly 16; the outer rotor assembly 16 encompasses the plastic-capsulated seat 152; and the sleeve 42 covers the circumferential wall of the outer rotor assembly 16.

With regard to the blower, the sleeve 42 covers the circumferential wall of the outer rotor assembly 16. The installation is convenient and easy to operate.

The gap 43 is disposed between the plurality of blades 21 and the sleeve 42.

It will be obvious to those skilled in the art that changes and modifications may be made, and therefore, the aim in the appended claims is to cover all such changes and modifications.

What is claimed is:

1. A device, comprising:

1) a motor;

2) a tubular wind wheel;

3) a mounting plate; and 4) a connection part;

wherein:

the tubular wind wheel comprises a plurality of blades and a plurality of connection rings; the plurality of blades is connected to each other to form an elongated hollow body; the connection part is disposed in the elongated hollow body; the mounting plate is disposed outside one end of the tubular wind wheel; the motor is disposed on the mounting plate; at least a part of the motor extends into the elongated hollow body to connect to the connection part;

the connection part comprises a connection plate spaced from the one end of the tubular wind wheel; the connection plate is connected to the plurality of blades; the connection plate comprises a central hole and a lug boss surrounding the central hole; the motor comprises a rotating shaft passing through the central hole and being encircled by the lug boss;

the plurality of blades is connected to each other through the plurality of connection rings disposed at intervals; and the connection plate is disposed between two adjacent connection rings on the one end of the tubular wind wheel;

the connection plate comprises a plurality of vent holes around the central hole; and the motor comprises an outer rotor assembly, a stator assembly, a plastic-capsulated seat, and the rotating shaft; the stator assembly is disposed in the plastic-capsulated seat; the outer rotor assembly encompasses the plastic-capsulated seat; the rotating shaft is connected to the outer rotor assembly; one end of the rotating shaft extends out of the outer rotor assembly and is connected to the connection plate; the plastic-capsulated seat comprises a plurality of circumferential legs; and the mounting plate is fixedly connected to the plurality of circumferential legs.

2. A device, comprising:

1) a motor;

2) a tubular wind wheel;

3) a mounting plate; and 4) a connection part;

wherein:

the tubular wind wheel comprises a plurality of blades and a plurality of connection rings; the plurality of blades is connected to each other to form an elongated hollow body; the connection part is disposed in the elongated hollow body; the mounting plate is disposed outside one end of the tubular wind wheel; the motor is disposed on the mounting plate; at least a part of the motor extends into the elongated hollow body to connect to the connection part; and the plurality of blades are connected to each other through the plurality of connection rings disposed at intervals; one of the plurality of connection rings on the one end of the tubular wind wheel bends to form a sleeve parallel to the plurality of blades; the motor comprises an outer rotor assembly, a stator assembly, a plastic-capsulated seat, and the rotating shaft; the stator assembly is disposed in the plastic-capsulated seat; the rotating shaft is connected to the outer rotor assembly; the outer rotor assembly encompasses the plastic-capsulated seat; and the sleeve encircles a circumferential wall of the outer rotor assembly.

3. The device of claim 2, wherein a gap is disposed between the plurality of blades and the sleeve.

4. The device of claim 3, wherein the motor comprises a plurality of circumferential legs; a plurality of damping pads encircles the plurality of circumferential legs, respectively; the plurality of damping pads each comprises a first end face and a second end face connected to the first end face; the mounting plate is attached to the first end face of each damping pad; the mounting plate comprises a plurality of fasteners; the plurality of fasteners each is attached to the second end face of each damping pad to fix the motor on the mounting plate.

5. The device of claim 4, wherein the mounting plate comprises two subplates in threaded connection to each other.

6. The device of claim 2, wherein the motor comprises a plurality of circumferential legs; a plurality of damping pads encircles the plurality of circumferential legs, respectively; the plurality of damping pads each comprises a first end face and a second end face connected to the first end face; the mounting plate is attached to the first end face of each damping pad; the mounting plate comprises a plurality of fasteners; the plurality of fasteners each is attached to the second end face of each damping pad to fix the motor on the mounting plate.

7. The device of claim 6, wherein the mounting plate comprises two subplates in threaded connection to each other.

* * * * *